United States Patent [19]

Fletcher et al.

[11] 3,983,714

[45] Oct. 5, 1976

[54] CRYOSTAT SYSTEM FOR TEMPERATURES ON THE ORDER OF 2°K OR LESS

[76] Inventors: James C. Fletcher, Administrator of the National Aeronautics and Space Administration, with respect to an invention of Charles G. Miller, Pasadena; James B. Stephens, La Crescenta, both of Calif.

[22] Filed: July 24, 1975

[21] Appl. No.: 598,967

[52] U.S. Cl. ..... 62/217; 62/514 JT

[51] Int. Cl.[2] ..... F25B 41/04

[58] Field of Search ..... 62/514 R, 514 JT, 217, 62/467, 45, 55

[56] References Cited

UNITED STATES PATENTS

| | | | |
|---|---|---|---|
| 3,195,322 | 7/1965 | London | 62/514 R X |
| 3,252,291 | 5/1966 | Eder | 62/514 JT X |
| 3,376,712 | 4/1968 | London | 62/514 R X |
| 3,442,091 | 5/1969 | Klipping et al. | 62/514 R X |
| 3,447,333 | 6/1969 | Goodstein | 62/514 R X |

*Primary Examiner*—William F. O'Dea
*Assistant Examiner*—Ronald C. Capossela
*Attorney, Agent, or Firm*—Monte F. Mott; Wilfred Grifka; John R. Manning

[57] ABSTRACT

A cryostat system for cooling a device to a temperature on the order of 2°K or less includes a dewar, in which helium, in other than the superfluid state, is stored. Helium flows from the dewar through a heat exchanger tube and a restrictor tube, which controls the helium flow rate, into the cavity of a heat exchanger, to whose outer wall the device to be cooled is attached. A pressure regulator valve controls the pressure in the cavity to be very low, e.g., on the order of 30 Torr. As the helium exits the restrictor tube into the cavity, due to low pressure cavity, it becomes an aerosol mixture of helium gas and superfluid helium droplets at the desired temperature. The latter form a thin layer or film of superfluid helium on the inner side of the heat exchanger wall and thereby cool the device, which is attached to the wall to the desired temperature. The helium gas, formed during the exit of the helium into the cavity and the helium gas, formed from the superfluid helium, which is evaporated by absorbing heat from the device being cooled, are evacuated from the cavity. As they flow around the heat exchanger tube, through which helium flow from the dewar, heat is absorbed by the helium gas from the helium in the tube, so that the helium entering the cavity is at a lower temperature than the helium entering the tube from the dewar. The evacuated helium gas may be used for one or more purposes, including reducing the amount of radiated heat reaching the dewar, as well as serve as the propellant for spacecraft attitude control. The cryostat may be used to cool different devices to different temperatures on the order of 2°K or less during an entire mission or during selected independent periods for each device.

21 Claims, 4 Drawing Figures

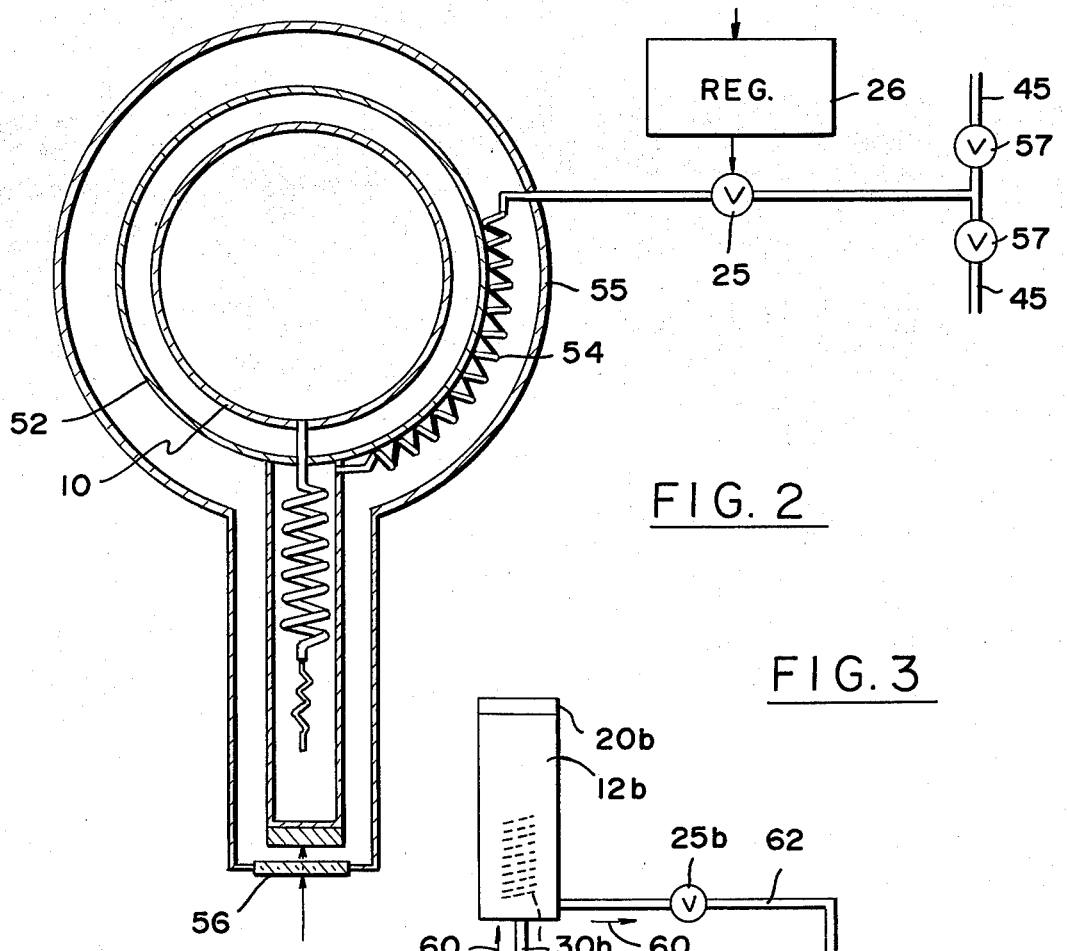
FIG. 2
FIG. 3
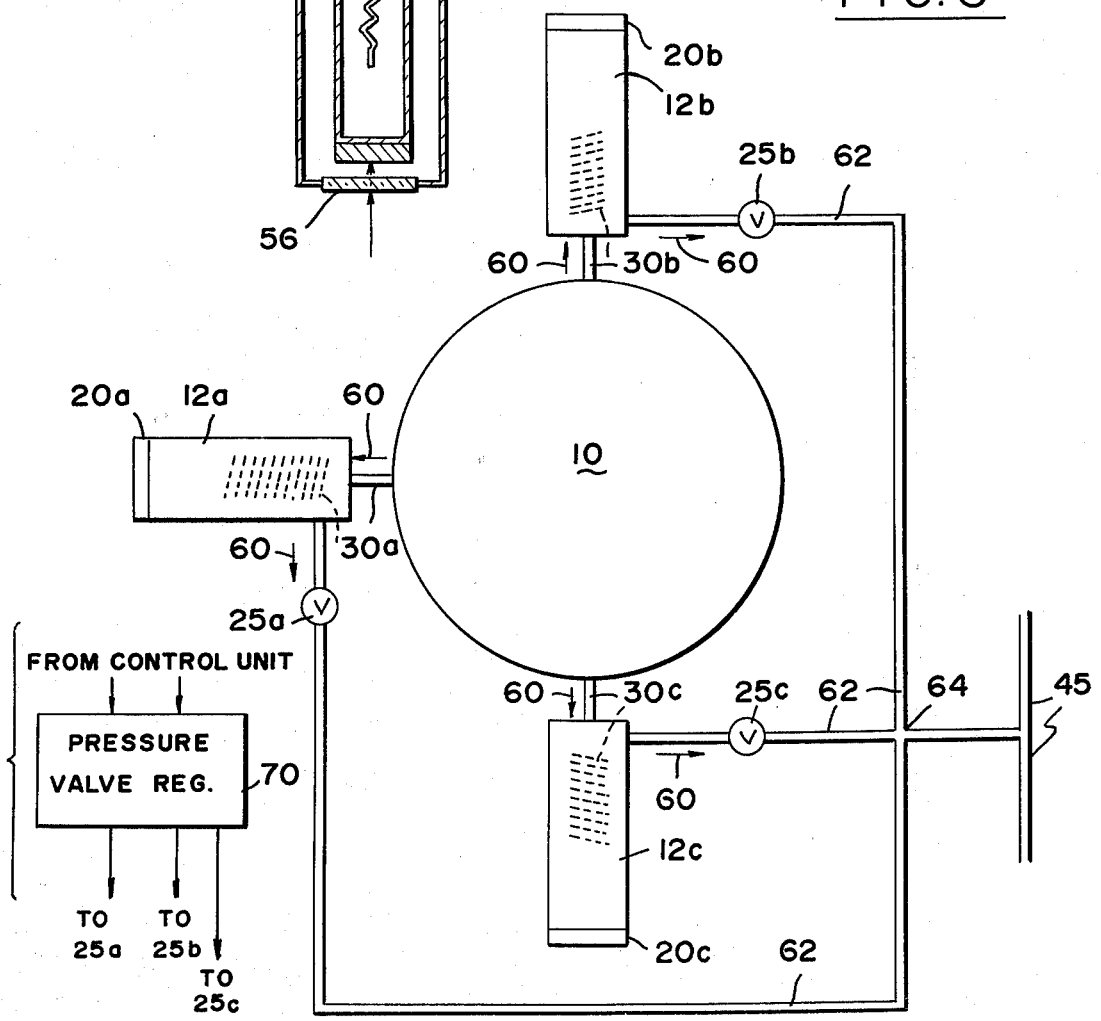

CRYOSTAT SYSTEM FOR TEMPERATURES ON THE ORDER OF 2°K OR LESS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention

The present invention generally relates to a new cryostat system and, more particularly, to a cryostat system for cooling a surface to which a device to be cooled is attachable, with superfluid helium, without the need to store superfluid helium.

2. Description of the Prior Art

There are many experiments, including some performed in space explorations in which cooling of devices down to very low temperatures on the order of 2°K or less is required for relatively long periods of time. For example, a spacecraft mission for mapping the celestial sphere in the far-infrared has been proposed. For such a mission, the infrared (IR) detector has to be maintained at about 2°K or less for long periods of time, on the order of six months. The cooling medium, generally referred to as the cryogen, which comes to mind for such an application is superfluid helium, often designated as HeII. As is known helium is present in the superfluid state at the temperature of its λ-point which is 2.18°K and below. Thus, from a temperature point of view HeII is a very desirable cryogen for temperatures of 2.18°K and less, such as 2°K or less.

One well known property of superfluid helium is that it flows through the smallest crack or flaw in metal structures, making its storage for use over extended periods most difficult. Also, very little is known about its behavior in the zero gravity environment of space. It is however believed that the problem of storing it in large quantities in space will be compounded by its superfluidity. For space exploration the superfluid helium will have to be stored in a tank generally referred to as a dewar which will be surrounded by a vacuum shield to minimize the increase in the helium temperature due to heat radiation. The large quantity of superfluid helium would tend to slosh around in the dewar thereby making accurate attitude controls of the spacecraft most difficult. Also the superfluid helium would tend to flow through the smallest flaws in the dewar into the vacuum shield thereby affecting the vacuum which will in turn reduce the shielding of the dewar from radiated heat.

Thus, a need exists for a cryostat system to cool one or more objects to very low temperatures on the order of 2°K or less without having to store a large quantity of superfluid helium. A further desirable feature of the cryostat system is to be able to store a large quantity of helium, in other than the superfluid state, to cool different objects located at different locations on a spacecraft to the same or different controllable temperatures on the order of 2°K or less over an extended period of time and to make maximum efficient use of the helium for other than object-cooling purposes.

OBJECTS AND SUMMARY OF THE INVENTION

It is a primary object of the present invention to provide a new cryostat system for cooling at least one object to temperatures on the order of 2°K or less.

Another object of the present invention is to provide a cryostat system, in which the stored cryogen is other than superfluid helium for cooling one or more objects to controllable temperatures on the order of 2°K or less.

A further object of the invention is to provide a cryostat system in which a cryogen of helium, other than in the superfluid state, is stored to separately cool remotely located objects on a spacecraft to variable controllable temperatures on the order of 2°K or less during controllable periods.

Yet another object of the invention is to provide a novel cryostat system for use in a spacecraft to cool one or more objects to different temperatures on the order of 2°K or less, with a helium cryogen stored in a common reservoir in other than the superfluid state, and in which the helium after being used to cool the one or more objects is further utilized for purposes other than object cooling.

These and other objects of the invention are achieved by providing a cryostat system in which a large quantity of helium, serving as the cryogen is stored in a dewar in other than the superfluid state. For each object to be cooled, cryogen from the dewar flows through a separate counterflow heat exchanger, at a rate controlled by a restrictor tube, into an expansion cavity, which is maintained at a controlled very low pressure. As the cryogen flows through the heat exchanger tube it is cooled by conduction, and when it exits the restrictor tube into the expansion cavity it is further cooled by evaporation and/or expansion or both, to produce a thin layer or film of superfluid helium at about 2°K or less on the inner side of the expansion cavity wall, to which the object or device to be cooled is attached on the outer side of the wall. Thus, the cavity is maintained at about 2°K or less by the superfluid helium, which serves as the cryogen.

Heat which is conducted from the device to be cooled vaporizes some of the superfluid helium layer to form gas, which together with helium gas, which is formed when the helium exits the restrictor tube, flow through the low pressure side of the heat exchanger, thereby cooling by conduction, the cryogen flowing in the heat exchanger tube from the dewar to the expansion cavity. The helium gas, which is purged from the expansion cavity by the low pressure therein may be used for various purposes, other than object cooling. The purged helium gas may be made to flow through a radiation shield surrounding the dewar and/or to control the spacecraft orientation as well as to purge optics which may be associated with the device to be cooled from contaminants which may be depositable thereon.

BRIEF DESCRIPTION OF THE DRAWINGS

FIG. 2 is a simplified side sectional view of another embodiment of the invention;

FIG. 3 is a simplified diagrammatic arrangement of another embodiment of the invention.

DESCRIPTION OF THE PREFERRED EMBODIMENTS

Figures 1, 1A:
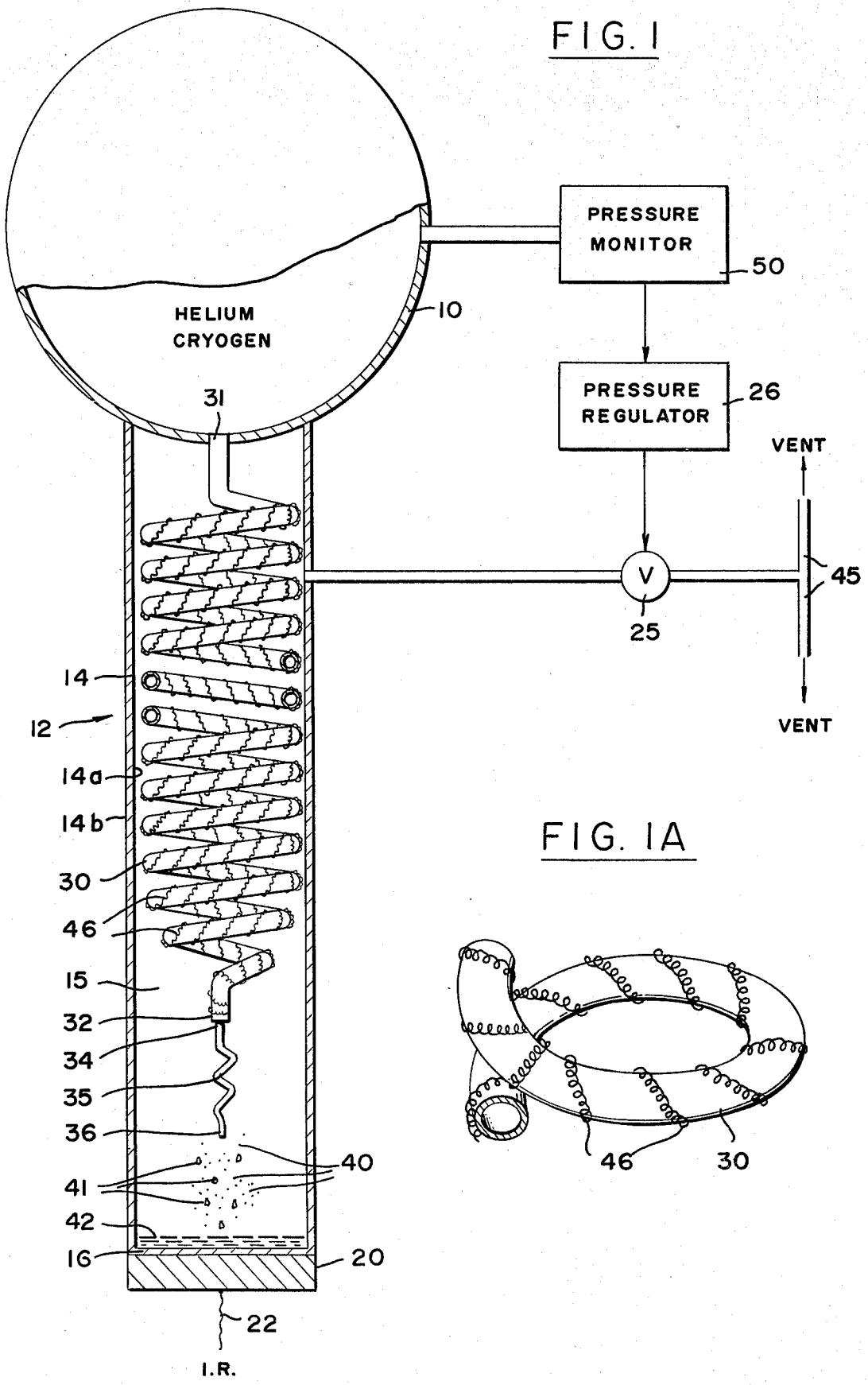
FIG. 1 is a simplified side view, partially in section of the invention.
FIG. 1A is a fragmentary view of a portion of a heat exchanger tube.

Attention is first directed to FIG. 1 which is a simplified diagram, useful in explaining the basic principles of operation of the cryostat system of the present invention. The system includes a dewar 10, in which helium, which is to serve as the cryogen is stored. For an extended spacecraft mission, e.g., six months a large quantity of helium is required. Therefore, prior to the start of the mission, a large quantity of helium is stored in the dewar at a high pressure, e.g., 300–400 psi. As the mission progresses, during which helium flows out of the dewar, as will be explained hereinafter, the pressure in the dewar drops. The system may be designed so that at the end of the mission the pressure in the dewar is above the pressure of the critical point of helium which is about 32 psi. Generally, the temperature of the helium in the dewar is at all times above the temperature of the helium λ point, which is 2.18°K. During the mission, the temperature of the helium tends to increase due to heat absorbed by radiation. This temperature increase may be held to a minimum by proper dewar shielding, as will be described hereinafter. For explanatory purposes, it will be helpful to assume that the pressure and temperature of the helium do not change over an extending period of time in spite of the flow of helium from the dewar and heat absorbed by radiation. The helium in the dewar during the entire mission is other than in superfluid state, i.e., other than HeII.

Associated with the dewar 10 is a counterflow heat exchanger 12. The relative sizes of the dewar 10 and the heat exchanger are highly exaggerated for explanatory purposes only. The heat exchanger 12 is very small compared to the dewar 10. The latter may be several feet in diameter, while the heat exchanger 12 may be only a few inches long and a fraction of an inch in diameter. The heat exchanger 12 consists of a wall 14 whose inner and outer sides are designated by **14*a* and 14*b*, respectively. The wall 14 is shaped so as to form a hollow cavity 15. The portion of the wall 14, remote from the dewar, is designated by numeral 16. It is this wall portion which is to be cooled to the desired low temperature, so that when a device 20, such as an IR detector, is properly attached to the outer side 14*b* of wall portion 16 the device is cooled to the desired temperature. In FIG. 1, numeral 22 designates IR radiation which is detected by IR detector 20**.

As shown in FIG. 1 the system also includes a pressure regulating arrangement, consisting of a valve 25 controlled by a pressure regulator 26. The latter by means of valve 25 controls the pressure in the cavity to be sufficiently low so as to produce the desired cooling, as will be described hereinafter. For explanatory purposes only, it is assumed that for temperatures on the order of 2°K or less, the pressure in cavity 15 is regulated to be on the order of 30 Torr or less. In any constructed system the required cavity pressure for a given temperature may be determined from a calibration test.

The heat exchanger 12 includes a helically shaped heat exchanger tube 30 of small internal diameter (ID), e.g., several mil. A fragmentary view of the tube 30 is shown in FIG. 1A. The inlet end 31 of tube 30 is in communication with dewar 10 while its outlet end 32 is connected to the inlet end 34 of a restrictor tube 35, whose outlet end is designated by numeral 36. The ID of restrictor tube 35 is generally less than that of tube 30. It may be on the order of 1 mil. It, like tube 30 is generally shaped in the form of a helix.

In operation, since the pressure in the dewar 10 is significantly greater than in cavity 15, helium flows from the dewar into the cavity through tubes 30 and 35 at a rate which is primarily controlled by the ID of the restrictor tube 35, and its length. The primary function of the tube 30 is to serve as a heat exchanger by enabling helium gas which is formed in the cavity 15, as will be described hereinafter, and which is removed from the cavity through valve 25 to absorb heat from the helium flowing through tube 30 by conduction and thereby cool the helium to a temperature below the temperature of the helium which enters tube 30 from the dewar through inlet end 31.

In operation, the helium which flows through the tubes 30 and 35, at a rate primarily controlled by the restrictor tube 35, exits into the cavity through outlet or discharge end 36. Due to the very large difference between the pressures in the dewar 10 and in the cavity 15 the helium which enters the cavity becomes an aerosol mixture of helium gas and helium droplets. In FIG. 1 the helium gas is designated by dots 40 and the helium droplets by circles 41. As will be pointed out hereinafter, due to the very low pressure in the cavity the droplets 41 cool by partial evaporation and become droplets in the superfluid state at the desired temperature.

Most if not all of the droplets 41 precipitate to form a thin flim or layer of superfluid helium, designated by 42, on the innerside **14*a* of wall portion 16. It is this film of superfluid helium which serves to cool the device 20 to the desired temperature. On the other hand the helium gas in the mixture which is formed when the helium exits the restrictor tube, together with any helium droplets entrained therein, travels upwardly and is purged or evacuated from the cavity through valve 25, and is finally vented out through one or more vents 45 into space. To improve the system's efficiency the tube 30 is surrounded by wire fins designated by numeral 46 in FIGS. 1 and 1A. The wire fins 46 are shown as a coil spring which is wound around and attached, such as by brazing or soldering to tube 30**.

The function of the wire fins 46 is to produce a tortous path for the helium gas which is being evacuated or purged from the cavity. As a result, the helium gas comes in direct contact with the wire fins, which are in turn in direct thermal contact with the heat exchanger tube 30 through which helium flows from the dewar to the cavity. Since the helium gas is considerably colder than the helium which flows down tube 30, heat is conducted from the helium in the tube through tube 30 and wire fins 46 to the colder helium gas. Therefore the helium flowing down the tube is cooled by conduction. It is thus seen that in the present invention the refrigeration (cooling) of the helium gas which is not utilized to cool the device 20 is not completely wasted. Rather, as it flows through the low pressure side of the cavity 15 it absorbs heat from the incoming helium and thereby cools the latter, so that the helium exiting into the cavity 15 is at a lower temperature than the helium flowing into tube 30 from dewar 10.

It is appreciated that to maintain the device 20 at the desired temperature heat is continuously absorbed by the superfluid helium layer 42 from the device 20 through wall portion 16. Due to the absorbed heat some of the superfluid helium evaporates to form helium gas. However, the layer 24 is continuously augmented by more supperfluid helium droplets, formed from the helium exiting the restrictor tube 35. The helium gas, formed from the evaporated superfluid helium layer 42, is also evacuated through valve 25, and as it passes around the helical tube 30 with its wire fins 46 it also absorbs heat from the hotter helium flowing in the tube 30, to thereby further contribute to the cooling of the helium in the tube 30, which flows toward and exits into cavity 15.

Form the foregoing it should be appreciated that even though the device 20 is cooled by a layer 42 of superfluid helium to a temperature of 2°K or less, the helium which is stored in dewar 10 is not in the superfluid state, hereinafter referred to as the non-superfluid helium. Thus, the problems of storing a large quantity of superfluid helium, such as for use in a space environment, is eliminated with the present invention. Preferably, the minimum temperature of the non-superfluid helium which is present in the dewar 10 should be such that the helium exiting into the cavity 15 is non-superfluid liquid helium, generally designated as HeI. It is this liquid helium, HeI which is converted into the aerosol mixture of the helium gas and superfluid helium droplets.

The manner in which the non-superfluid liquid helium is converted into the aerosol mixture may be explained as follows. As the non-superfluid helium enters the cavity 15, in which the pressure is very low, e.g., on the order of 30 Torr, it is subjected to a very large pressure drop. It is reasonable to assume that the pressure of the helium just before exiting the restrictor tube is for all practical purposes the same or only slightly lower than the pressure in dewar 10. The minimum pressure in the dewar would generally be above the pressure of the critical point of helium which is on the order of 32 psi. Due to the large pressure drop the helium, exiting the restrictor tube 35, breaks up into droplets, and due to the very low pressure in the cavity, these droplets partially vaporize. As a result they become smaller but more importantly colder, due to the heat of vaporization provided by the droplets as they are partially vaporized. The vaporization continues and the droplets of the non-superfluid helium become colder until the vapor pressure is equal to the low cavity pressure. When the non-superfluid helium droplets cool to 2.18°K and below, they change to superfluid helium droplets. It is assumed that at a cavity pressure on the order of 30 Torr the equilibrium temperature will be on the order of 2°K.

As previously explained these superfluid droplets precipitate and form superfluid helium layer or film 42. It should be appreciated that in practice some non-superfluid droplets may precipitate and become part of layer 42. However, due to the layer's low temperature of about 2°K these droplets will be cooled and change into the superfluid state. Also, some of the formed helium gas may condense on the inner surface of wall portion 16 and form superfluid helium droplets which will become part of the superfluid helium layer 42. Thus, in accordance with the present invention although non-superfluid helium is stored in the dewar 10, superfluid helium in the form of layer 24 is formed and used to cool the device 20 to 2°K or less. The change of the droplets, which are part of the aerosol mixture which is formed from the helium exiting the tube 35, to superfluid helium droplets occurs so fast that for all practical purposes the aerosol mixture produced by the exiting helium can be thought of as essentially consisting of helium gas and superfluid helium droplets.

It should be appreciated that the actual temperature of layer 42 and therefore the temperature to which the device 20 is cooled is primarily dependent on the low pressure in the cavity, which hereinbefore was assumed for explanatory purposes to be 30 Torr for 2°K. As previously indicated in any practical system the exact pressure, needed to provide 2°K cooling can be established with minor initial calibration tests. Clearly, a temperature lower than 2°K can be attained with lower cavity pressures. Generically, the invention can be used to cool a device to 2.18°K or less, since 2.18°K is the helium λ-point temperature and is the highest temperature at which helium can be present in the superfluid state. Such cooling is achievable without having to store a large quantity of superfluid helium in dewar 10.

It should be stressed that although the cooling of the device 20 is achieved with the superfluid helium layer 42, the cold helium gas which is produced in the cavity, is not wasted. Rather, it is used to lower the temperature of the helium which flows from the dewar to the cavity through the helical tube 30, as the helium gas is evacuated (purged) from the cavity. Thus, the overall system efficiency is increased. As is appreciated from the foregoing description the function of the restrictor tube 35 is to control the rate of flow of the helium from the dewar, and thereby control the amount of refrigeration which is produced. Clearly, the rate of flow would depend on the amount of heat which need be absorbed from the device 20, i.e., the amount of refrigeration necessary to maintain the device at the desired temperature. The helium rate of flow is primarily a function of the diameter and length of restrictor tube 35 which may be tailored for the specific case to which the novel system may be applied.

Over an extended mission, e.g., six months as helium flows out of the dewar the pressure therein would drop. Therefore the difference between the dewar and the cavity pressures will decrease during the mission duration. To optimize the system it may be desirable to monitor the dewar pressure and as a function thereof continuously control the cavity pressure by means of regulator 26 to insure that the desired cooling temperature is maintained. As shown in FIG. 1 this may be achieved by monitoring the dewar pressure by a pressure monitor 50 whose output can then be supplied to regulator 26.

It should be stressed that in the present invention if valve 25 is closed, so as to prevent the venting of any helium gas therethrough, the pressure in the cavity will continue to build up until it reaches the pressure in dewar 10. When the cavity pressure equals the dewar pressure, the flow of helium from the dewar to the cavity will stop. Thus, the cooling of the device 20 would terminate. It should thus be appreciated that in addition to controlling the temperature to which the device 20 is cooled, by controlling the cavity pressure, such control can be used to limit the cooling of the device during one or more periods during a long space mission, simply by regulating the cavity pressure, by means of valve 25 controlled by regulator 26.

In FIG. 1, it was assumed that the helium gas, produced in the cavity, directly exits the latter and after passing the pressure control valve is vented into space through vents 45. In accordance with another embodiment of the invention as will be explained in connection with FIG 2, the helium gas which is purged from the cavity 15 is used to absorb some of the heat which is radiated to the dewar 10, and thereby at least reduce the increase of the helium temperature in the dewar due to heat radiated to the dewar.

As shown in FIG. 2, the dewar 10, containing the helium, is shown surrounded by a shield 52 to which a conduit 54 is attached. To simplify FIG. 2 the tube 54 is shown attached only to a portion of shield 52. An outer dewar shield 55 surrounds shield 52 and may extend to surround the heat exchanger 12 and accommodate a window 56 through which IR radiation is transmitted to the device 20. In this embodiment a vacuum is assumed to be present between dewar 10 and shield 52 as well as between shield 52 and the other shield 55, in order to minimize the increase in the temperature of the helium in the dewar 10 by heat radiated to and absorbed by the outer shield 55. In this embodiment the helium gas which exits the cavity 16 flows through conduit 54 before passing through valve 25 to vents 45. In practice, the helium gas exiting the cavity, even after absorbing heat from the helium flowing through tube 30, will still be at a lower temperature than the helium in the dewar 10. Thus, by passing it through conduit 54, it will absorb some of the heat radiated toward the dewar through outer shield 55 and thereby reduce the increase of the helium temperature in the dewar due to the radiated heat.

The cold helium gas which is produced in the cavity 15 in addition to cooling the incoming helium which flows through tube 30, and serving to absorb some of the heat which is radiated to the dewar, in order to reduce the helium temperature increases therein, may be used for one or more additional purposes. As shown in FIGS. 1 and 2 the helium gas is assumed to be vented into space through two opposite vents 45. With two such opposite vents spacecraft torquing can be avoided. In practice, however, the helium gas may be used as the propellant for spacecraft attitude control. An array of four or more vents 45 may be employed together with appropriate flow control valves in order to control the flow of the helium gas through each of the vents. In FIG. 2, such control valves for the two vents 45 are designated by numerals 57. With such an arrangment by controlling the flow of the helium gas through the various valves 57, which may be controlled by signals from an appropriate source, the attitude of the spacecraft can be controlled quite easily. Furthermore, if desired before venting the helium gas through the vents into space the stream of gas may be passed through any appropriate device on the spacecraft, e.g., an optical assembly in order to blow away and/or prevent any contaminants from becoming deposited on the assembly parts.

It should be pointed out that although hereinbefore the invention has been described in connection with cooling a single device 20, the invention is not intended to be limited thereto. The novel invention may be used to cool several, generally designated as *n*, different devices to different temperatures during the entire mission or during one or more selected periods of the mission with the helium stored in the common dewar 10. In such an embodiment separate heat exchangers are required, one for each device. Also, for each heat exchanger a separate cavity pressure regulating arrangement is needed, in order to control the cavity pressure to the desired level and thereby control the temperature to which the device which is attached to the heat exchanger wall is cooled.

FIG. 3 is a simplified diagram of the dewar 10 and three heat exchangers 12*a*, 12*b* and 12*c* to which helium from the dewar flows through three separate tubes 30*a*, 30*b* and 30*c* to cool three separate devices 20*a*, 20*b* and 20*c* Arrows 60 indicate the helium flow directions from the dewar and the heat exchangers. The pressures in the cavities of the three heat exchangers are assumed to be controlled by valves 25*a*, 25*b* and 25*c*, each of which performs the function of valve 25, as hereinbefore explained in connection with the embodiment shown in FIG. 1 The helium gas, through these valves may be passed through the conduits 62 to a common manifold 64 and thereform vented to space through vents 45. If desired the helium gas from the three exchangers present at manifold 64 may be used for any of the purposes, hereinbefore described, prior to being vented into space.

One of the major advantages of the embodiment shown in FIG. 3 is that devices, located at different locations on a spacecraft, may be cooled with helium from a common source, i.e., dewar 10. It should be pointed out that when a device to be cooled is located at a significant distance from the dewar the portion of the tube 30 extending from the dewar to the heat exchanger, associated with the particular remotely-located device, should be thermally insulated to minimize heat absorption by the helium flowing therein from the dewar to the heat exchanger.

It should again be stressed that during the mission the cooling of any of the devices may be terminated by closing the valve connected to the heat exchanger, associated with the particular device, so that when the pressure in the cavity equals that in the dewar helium flow to the particular heat exchanger terminates. It should be stressed however, that termination of the cooling of one device does not affect the cooling of the other devices. Also, the cooling of any device may be resumed by re-establishing by means of the flow control valve the desired low pressure in the cavity of the heat exchanger, associated with the particualr device, again without affecting the cooling of the other devices. If desired, a common pressure valve regulator unit, designated in FIG. 3 by numeral 70, which is responsive to appropriate command signals from an appropriate source, such as a control unit on the spacecraft, may be used to control individually each of the pressure control valves 25*a*–25*c* of the cryostat system, so as to control the cooling of the various devices to the required different temperatures during the entire mission, or during desired periods which may differ for the different devices.

From the foregoing description it should thus be apparent that in the novel cryostat system of the present invention helium in the non-superfluid state is stored in a common dewar. For each device to be cooled a separate heat exchanger is required. Helium flows from the dewar into the heat exchanger's cavity through a heat exchanger tube and through a restrictor tube which controls the rate of helium flow. A separate pressure regulating valve controls the pressure in the cavity to be sufficiently low so that when the helium flowing from the dewar exits the cavity it becomes an aerosol mixture of helium gas and helium droplets which turn into superfluid helium droplets at the temperature to which the device is to be cooled. Since the highest temperature of helium in the superfluid state is that represented by its λ-point temperature which is 2.18°K, in general the invention may be used to cool any device with superfluid helium to a temperature of 2.18°K or less. Thus, the expression "on the order of 2°K or less" is intended to include temperatures of 2.18°K or less.

It should be stressed that even though the cooling is achieved with superfluid helium, the helium which is stored in the common dewar is not in the superfluid state. Also, it should be stressed that by controlling the cavity pressure the actual temperature to which the device is cooled as well as the periods of cooling are easily regulatable by regulating the cavity pressure. As previously pointed out the function of the restrictor tube is to control the rate of flow of the helium into the cavity which is required to maintain the device being cooled at the desired temperature. The flow rate is controllable by the ID of the restrictor tube and its length. The flow rate for any desired temperature will of course depend on the amount of heat which has to be removed from the device to maintain it at the desired temperature. Although the restrictor tube is believed to be preferred arrangement for helium flow rate control, other arrangements, such as appropriate plugs, may be employed instead of the restrictor tube.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A cryostat system for cooling a device comprising:

a source of helium at a first pressure;

heat exchanger means comprising a heat conducting wall defining an internal cavity, with the device to be cooled being attachable to the other side of a selected portion of said wall, said heat exchanger means including tube means having an inlet end in communication with said helium source and a discharge end disposed in said cavity, for providing a path for helium to flow from said source into said cavity and for regulating the helium flow rate; and regulating means for regulating the pressure in said cavity definable as the second pressure to be substantially less than said first pressure but not greater than the pressure of the λ point of helium so that helium exiting said discharge end into said cavity is in the form of an aerosol mixture of helium gas and superfluid helium droplets, the latter forming a film of superfluid helium on the inner side of said selected wall portion to which the device is attachable, the temperature of said superfluid helium film being a function of said second pressure in said cavity but not greater than the temperature of the λ point of helium, said regulating means including means for evacuating the helium gas formed in said cavity from said cavity so as to maintain said second pressure in said cavity.

2. The system as described in claim 1 wherein said tube means include a heat exchanger tube having an inlet end in communication with said helium source and an outlet end, and helium flow rate control means having an inlet end connected to the heat exchanger tube's outlet end, and an outlet end, defining said discharge end, with helium flowing from said source into said cavity through said heat exchanger tube and said helium flow rate control means, said heat exchanger tube being positioned in said cavity so that the evacuated helium gas passes by said tube and absorbs, through said tube, heat from the helium flowing in said tube, so as to reduce the temperature of the helium flowing in said tube.

3. The system as described in claim 2 further including thermally conductive fin means in thermal contact with the outer surface of said heat exchanger tube, for increasing the conduction of heat from the helium flowing in said heat exchanger tube to said helium gas through said heat exchanger tube and the fin means in contact therewith.

4. The system as described in claim 2 wherein said heat exchanger tube has a first internal diameter, and said helium flow rate control means comprises a restrictor tube of a second internal diameter which is less than said first internal diameter, said restrictor tube having an inlet end coupled to the heat exchanger tube outlet end, and an outlet end, defining said discharge end, through which helium enters said cavity, the helium flow rate being substantially a function of the second internal diameter of said restrictor tube, its length between its inlet and outlet ends and the difference between said first and second pressures.

5. The system as described in claim 4 further including thermally conductive fin means in contact with the outer surface of said heat exchanger tube, for increasing the conduction of heat from the helium flowing in said heat exchanger tube to said helium gas through said heat exchanger tube and the fin means in contact therewith.

6. The system as described in claim 5 wherein said first pressure is not less than the critical pressure of helium and said second pressure is regulated by said regulating means so that the temperature of said superfluid helium film is on the order of 2°K.

7. The system as described in claim 2 wherein said first pressure is not less than the critical pressure of helium and said heat exchanger tube has a first internal diameter and said helium flow rate control means comprises a restrictor tube of a second internal diameter which is less than said first internal diameter, said restrictor tube having an inlet end coupled to the heat exchanger tube outlet end, and an outlet end defining said discharge end through which helium enters said cavity, the helium flow rate being substantially a function of the second internal diameter of said restrictor tube, its length between its inlet and outlet ends and difference between said first and second pressures.

8. The system as described in claim 2 further including conduit means surrounding said helium source, said conduit means being in communication with said cavity, so that helium gas, evacuated from said cavity by said regulating means, passes through said conduit means to absorb at least part of thermal energy directed to said helium source.

9. The system as described in claim 8 wherein said heater exchanger tube has a first internal diameter and said helium flow rate control means comprises a restrictor tube of a second internal diameter, which is less than said first internal diameter, said restrictor tube having an inlet end coupled to the heat exchanger tube outlet end, and an outlet end, defining said discharge end, through which helium enters said cavity, the flow rate being substantially a function of the second internal diameter of said restrictor tube, its length between its inlet and outlet ends and difference between said first and second pressures.

10. The system as described in claim 9 further including thermally conductive fin means in thermal contact with the outer surface of said heat exchanger tube, for increasing the conduction of heat from the helium flowing in said heat exchanger tube to said helium gas through said heat exchanger tube and the fin means in contact therewith.

11. The system as described in claim 9 wherein said first pressure is not less than the critical pressure of helium and said second pressure is regulated by said regulating means so that the temperature of said superfluid helium film is on the order of 2°K.

12. The system as described in claim 11 further including thermally conductive fin means in thermal contact with the outer surface of said heat exchanger tube, for increasing the conduction of heat from the helium flowing in said heat exchanger tube to said helium gas through said heat exchanger tube and the fin means in contact therewith.

13. A cryostat system for cooling a device comprising:

a source of helium at a first pressure which is not less than the critical pressure of helium and at a first temperature which is greater than the temperature of the λ point of helium;

heat exchanger means comprising a heat conducting wall defining an internal cavity, with a device to be cooled attachable to the outer side of a selected portion of said wall, said heat exchanger means including a coiled heat exchanger tube having an inlet end in communication with said source and an outlet end, and helium flow rate control means having an inlet end connected to the heat exchanger tube outlet end and having an outlet end, defining a discharge end, the pressure in said cavity being definable as the second pressure, which is less than said first pressure, whereby helium flows from said source through said heat exchanger tube and said helium flow rate control means and exits into said cavity through said discharge end; and regulating means for regulating said second pressure in said cavity to be below the pressure of the λ point of helium, so that the helium exiting said discharge end into said cavity is in the form of an aerosol mixture of helium gas and superfluid helium droplets, the latter forming a film of superfluid helium on the inner side of said selected wall portion to which the device is attachable, the temperature of said superfluid helium film being a function of said pressure in said cavity but not greater than the temperature of the λ point of helium, said regulating means including means for evacuating the helium gas formed in said cavity from said cavity so as to maintain said second pressure in said cavity.

14. The system as described in claim 13 wherein said heat exchanger tube is positioned in said cavity whereby the evacuated helium gas passes by said tube and absorbs heat from the helium flowing in said tube toward helium flow rate control means, so as to reduce the temperature of the helium in said heat exchanger tube.

15. The system as described in claim 14 further including thermally conductive fin means in thermal contact with the outer surface of said heat exchanger tube, for increasing the conduction of heat from the helium flowing in said heat exchanger tube to said helium gas through said heat exchanger tube and the fin means in contact therewith.

16. The system as described in claim 13 wherein said heat exchanger tube has a first internal diameter, and said helium flow rate control means comprises a restrictor tube of a second internal diameter which is less than said first internal diameter, said restrictor tube having an inlet end coupled to the heat exchanger tube outlet end, and an outlet end, defining said discharge end, through which helium enters said cavity, the helium flow rate being substantially a function of the second internal diameter of said restrictor tube, its length between its inlet and outlet ends and the difference between said first and second pressures.

17. The system as described in claim 16 further including thermally conductive fin means in contact with the outer surface of said heat exchanger tube, for increasing the conduction of heat from the helium flowing in said heat exchanger tube to said helium gas through said heat exchanger tube and the fin means in contact therewith.

18. The system as described in claim 13 further including conduit means surrounding said helium source, said conduit means being in communication with said cavity, so that helium gas, evacuated from said cavity by said regulating means, passes through said conduit means to absorb at least part of thermal energy directed to said helium source.

19. The system as described in claim 18 wherein said heat exchanger tube is positioned in said cavity whereby the evacuated helium gas passes by said tube and absorbs heat from the helium flowing in said tube toward helium flow rate control means, so as to reduce the temperature of the helium in said heat exchanger tube.

20. The system as described in claim 19 wherein said heat exchanger tube has a first internal diameter, and said helium flow rate control means comprises a restrictor tube of a second internal diameter which is less than first internal diameter, said restrictor tube having an inlet end coupled to the heat exchanger tube outlet end, and an outlet end, defining said discharge end, through which helium enters said cavity, the helium flow rate being substantially a function of the second internal diameter of said restrictor tube, its length between its inlet and outlet ends and the difference between said first and second pressures.

21. The system as described in claim 20 further including thermally conductive fin means in contact with the outer surface of said heat exchanger tube, for increasing the conduction of heat from the helium flowing in said heat exchanger tube to said helium gas through said heat exchanger tube and the fin means in contact therewith.

* * * * *